US007037127B2

(12) United States Patent
Williams

(10) Patent No.: US 7,037,127 B2
(45) Date of Patent: May 2, 2006

(54) LOW FORCE ELECTRICAL CONTACT

(76) Inventor: Roger C. Williams, 2024 Pueblo Ct., Santa Rosa, CA (US) 95409

( * ) Notice: Subject to any disclaimer, the term of this patent is extended or adjusted under 35 U.S.C. 154(b) by 319 days.

(21) Appl. No.: 10/042,567

(22) Filed: Nov. 20, 2001

(65) Prior Publication Data

US 2002/0055305 A1 May 9, 2002

Related U.S. Application Data

(60) Provisional application No. 60/252,801, filed on Nov. 22, 2000, provisional application No. 60/221,612, filed on Jul. 28, 2000.

(51) Int. Cl.
*H01R 13/64* (2006.01)

(52) U.S. Cl. ..... 439/251; 439/857

(58) Field of Classification Search ..... 439/252, 439/842, 843, 852, 856, 859, 862, 251, 857
See application file for complete search history.

(56) References Cited

U.S. PATENT DOCUMENTS

| | | | | |
|---|---|---|---|---|
| 278,346 | A * | 5/1883 | Long | 439/846 |
| 3,596,235 | A * | 7/1971 | Sapienza et al. | 439/682 |
| 5,108,318 | A * | 4/1992 | Sakurai et al. | 439/744 |
| 5,599,213 | A * | 2/1997 | Frommer et al. | 439/857 |
| 5,649,837 | A * | 7/1997 | Arnold | 439/557 |

* cited by examiner

*Primary Examiner*—James R. Harvey
(74) *Attorney, Agent, or Firm*—Risto A. Rinne, Jr.

(57) ABSTRACT

An apparatus for forming and disconnecting an electrical path includes a split tine socket that is formed of a high yield strength conducting material or metal and which includes a plurality of tines. Each tine functions as a two stage spring to supply a normal force that urges the tine toward the center of the socket. Each tine is machined to include an undercut portion proximate a tip. The undercut portion of each tine produces a patch of material having a greater thickness than the undercut portion. The patch provides an area of electrical contact intermediate a pin and the tine and is adapted to receive and accommodate a pin that does not align axially with the socket. Each patch ensures that physical, and therefore electrical, contact with the pin will occur at the tip of each tine. A plurality of sockets are typically included in a connector.

10 Claims, 4 Drawing Sheets

DETAIL A (MATED)

DETAIL A (UN-MATED)

DETAIL A (MATED)

LOW FORCE ELECTRICAL CONTACT

This application claims the benefit of priority of Provisional Patent Application Ser. No. 60/252,801 that was filed on Nov. 22, 2000.

This application is related to a pending patent application entitled "Electrical Contact", by the same inventor, application Ser. No. 09/916,749 filed on Jul. 27, 2001, which application claims the benefit of Provisional Patent Application Ser. No. 60/221,612 that was filed on Jul. 28, 2000. This co-pending patent application, in its entirety, is incorporated by reference herein.

BACKGROUND OF THE INVENTION

1. Field of the Invention

The present invention, in general relates to electrical contacts and, more particularly, to electrical contacts that provide minimal insertion-removal force and which are tolerant of axial misalignment of the contacts.

The pin and socket configuration of electrical contacts is common in a variety of industries and frequently includes a solid pin contact that mates to a slotted or "split tine" type of a socket contact.

The split tine socket is typically deformed radially inward after machining in order to achieve an adequate normal force when mated to the pin contact. This deformation is sometimes referred to as a "set".

Another method of achieving inward normal force on the pin contact is the use of a separate coil spring or "C" clip spring that is wrapped around the tip of the tines and which tends to urge them inward, toward the pin.

A common type of problem that occurs generally with these types of contacts involves achieving a consistent normal force. A consistent normal force results in consistent mate/unmate forces and also in a consistent, and preferably, low voltage drop across the connection.

Maintaining a consistent normal force over the life of the contact, which may be subjected to harsh environments and abuse, remains a vexing problem in the industry.

These issues are especially important when high currents are involved, such as when fast charging electric vehicles. Also, the connectors that utilize these types of contacts may be handled by personnel with limited strength, as is discussed in greater detail hereinafter.

It is desirable that such contacts have low mate and unmate forces and that those forces remain relatively constant throughout the connector's useful service life.

If the mate/unmate force is too high, the connector, having a plurality of contacts, may be unusable by some people of limited strength. This is especially true for connectors that carry significant amounts of current.

Conversely, if the contacts loosen excessively over time (i.e., if the normal force decreases substantially), a resulting increase in resistance and therefore voltage drop can occur. This, in turn, will cause a rise in temperature and may result in an unsafe situation.

Setting the tines of the contact requires using a material with a sufficiently low yield strength such that sufficient permanent deformation can take place within the constraints of the slit width, in order to achieve the desired normal force.

Unfortunately, permanent deformation in the outward radial direction or "loosening" can occur over the life of the contact resulting in a reduction of normal force and an increase in voltage drop. Loosening is a common problem with connectors that are mated and unmated repeatedly.

This is especially true when the connector design allows a rocking motion to be used as an aid in mating and unmating. Installing an external helper spring wrapped around the tip of the tines can help alleviate this problem because the spring is made of a high yield strength material that is resistant to permanent deformation.

However, the external spring's spring rate, dimensions, and frictional characteristics contribute to a variation in normal force. Also, the frictional characteristics of the spring/tine interface are subject to change over the life of the contact, especially in harsh environments.

Accordingly, the selection of an external helper spring must take all of these variables into account and, therefore, one must be selected that will still provide the minimal normal force that is required over the life of the contact. Selecting a helper spring that can supply the necessary normal force after having taken into account the variables that are involved tends to increase the mate/unmate forces that are required. It also adds one more component part (i.e., the external spring) to the assembly of each contact.

Also, prior art design of contacts, especially high current contacts, has been based on the prevailing assumption that it is desirable to maximize the contact area intermediate a pin and a socket. The more contact area that occurs at the interface between the pin and the socket, it has been believed, will increase the opportunity for current to flow. It has been thought that current flow will occur at least somewhere wherever there is the potential for physical contact to occur, so the greater the potential for that contact to occur and to occur in as many places as possible, became the essence of optimum high current contact design theory.

It was further believed that a great amount of surface area for contact is absolutely necessary to support high current loading through the connector. The problem with maximizing contact area is that, for any given tine to pin pressure (i.e., normal force), a greater area for contact results in less normal force being applied at any given location. This tends to result in random spots of contact occurring. If contact is random, there is little assurance that any mechanical "wiping" will clean the pin and tines at the exact areas where physical contact will occur.

This, it has been found, decreases the current carrying ability of a contact over its life because oxidation that occurs is not optimally cleaned by the wiping action of the tine with the pin. Also a lower normal force also tends to increase electrical resistance in general.

With this to serve as a general background, there is one further condition that exacerbates the problem of high mate and unmate forces, and that is axial misalignment of the contacts that occurs after molding.

It is common that such types of connectors have rubber molded around the outside of the contacts. The contact position at the face of the rubber connector is held to tight tolerances by the tooling. This is intended to keep the longitudinal axes of the contacts as contained within the two mating connectors (i.e., the male and female halves) in parallel alignment with respect to each other prior to the molding process.

However, the molding process subjects the contacts to lateral loading forces which affect the individual contacts to varying degrees. A "fluid rubber" is injected into the molds and this exerts a force that bears upon the individual contacts. Misalignment can also occur in response to tensile forces on the wire that is crimped into the contact due to the molding pressure bearing on the wire where it exits from the mold.

Also, when the rubber cures it shrinks slightly and this tends to pull the contacts together toward the back portion of each contact.

Regardless of the causes, the axial parallelism of the individual contacts typically may vary from one to three degrees from normal (i.e., parallel).

This substantially tends to increase the mate/unmate forces. If it were not for axial misalignment, a six contact connector in which each of the contacts requires five pounds of force to mate or unmate would require six times five, or thirty pounds of force.

Because of axial misalignment, the actual force may be double that, or sixty pounds. This is a substantial problem, that heretofore has gone unresolved, especially for high current applications involving repeated mate and unmate connections per day.

As mentioned hereinabove, axial misalignment affects the various contacts in varying degrees. Those contacts that are disposed at the perimeter of the connector tend to experience greater misalignment than those that are disposed toward the center of the connector.

Also, all contacts are not the same size. The length of the pin and sockets are carefully chosen in these types of connectors so that an interlock feature will function properly. To accomplish this, the power contacts are typically longer than "control contacts". The control contacts are used to enable or disable current flow through the power contacts by closing or opening a circuit which activates a contactor or a relay. The control contacts are the last ones to physically connect during mating and the first to disconnect during unmating. This helps prevent arcing that would otherwise occur at the power contacts if the high-current power contacts were themselves used to make or break the current flow.

As a result of different locations as well as different contact sizes, there will be a variance in the force required to mate and unmate each connector. If six contacts are used that each average ten pounds of force for each contact (without axial misalignment), perhaps two of them (near the center) achieve ten pounds of force each, two others require fifteen pounds of force, and the remaining two require twenty pounds of force. Instead of the target mate/unmate force of sixty pounds, the actual force required may be ninety pounds, or one and one-half times what is desired.

As was mentioned briefly hereinabove, whenever the mate or unmate force is high, people tend to rock the plug back and forth as it is inserted into the socket. This tends to urge the tines outward toward a hood that surrounds the tines. The act of further opening the tines by itself tends to increase the force that is required. A lack of any clearance intermediate the interior of the tine and the exterior of the pin applies a force (during rocking or if axial misalignment of the contacts is present) that urges the tines outward. The act of further opening the tines (by the nose of the pin) tends to contribute toward premature wear of both the tine and the pin at the point of contact.

A lack of clearance intermediate the interior of the hood and the exterior of the tines not only makes for difficult rocking (because there is not sufficient space for the tines to be urged further away from a center axis of the contact when the hood is contacted by the tines) but it is likely to damage the contacts (i.e., most likely the tines).

This is because attempting to rock the male connector half (with the pins) as it is being inserted into the female connector half (with the sockets) when the tines are in contact with the hood subjects the tines to great stresses (at the point of contact by the pins) and this force can exceed the elastic limit of the tines, thereby deforming them and possibly changing their "set". This degrades the normal forces that are applied by the tines to the pin, possibly reducing the current-carrying capacity of the connector as well as its useful life.

Accordingly, there exists today a need for a low force electrical contact that is durable and reliable, adaptable for use in harsh environments, requires a minimal mate/unmate force, is tolerant of axial misalignment and is capable of carrying high currents.

2. Description of Prior Art

Electrical contacts are, in general, well known. While the structural arrangements of the known types of devices, at first appearance, may have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

A first important object of the present invention to provide a low force electrical contact that is tolerant of axial misalignment between any of the pins and sockets.

A second important object of the present invention to provide a low force electrical contact that does not substantially increase insertion or removal forces that are required to mate and unmate the connector when axial misalignment between any of the pins and sockets occurs.

It is an object of the present invention to provide a low force electrical contact that lessens the mate and unmate forces that are required.

It is also an important object of the invention to provide a low force electrical contact that is durable.

Another object of the invention is to provide a low force electrical contact that increases the current carrying ability of the contact.

Still another object of the invention is to provide a low force electrical contact that uses the tines as springs to supply a normal force.

Still yet another object of the invention is to provide a low force electrical contact that is adapted to distribute stress along its longitudinal length.

Yet another important object of the invention is to provide a low force electrical contact that includes limited areas, or patches, of physical contact intermediate a pin and tine.

A still further object of the invention is to provide a low force electrical contact that includes predictable areas of physical contact to occur intermediate a pin and tine.

A still further important object of the invention is to provide a low force electrical contact that provides a wiping action of the tine upon the pin which tends to clean that specific area of the pin with each mating/unmating cycle.

Still yet another important object of the invention is to provide a low force electrical contact that includes a reverse taper of a portion of a tine.

Still yet one further object of the invention is to provide a low force electrical contact that includes a two-stage tine.

Still one further valuable object of the invention is to provide a low force electrical contact that includes tines, at least a portion of which are formed of a high yield strength type of conducting metal.

A first continuing object of the invention is to provide a low force electrical contact that includes an undercut portion on an interior of a tine that provides and area that is adapted to receive a pin that is not in parallel axial alignment with respect to the tine.

A second continuing object of the invention is to provide a low force electrical contact that includes a space that is disposed on an exterior of a tine and intermediate a hood which provides an area that is adapted to permit the tine to expand into.

Briefly, a low force electrical contact that is constructed in accordance with the principles of the present invention has a split tine socket that is machined out of a high yield strength conducting metal such that neither tine setting nor external helper springs are required. Each tine acts as a two-stage spring and includes a first stage that is thicker near the base of the tine and a second stage that is thinner and which continues away from the base to the tip of the tine. The first stage adds compliance to side loads inflicted by the pin tip when a rocking motion is used to mate the connectors, thereby protecting the socket from permanent deformation or loosening. The outside diameter of the tines is tapered such that when a pin contact is mated, the outside profile becomes nearly cylindrical which maintains a minimal clearance to the inside diameter of a metallic hood which, in turn, constrains the tines and prevents them from loosening by being bent beyond their elastic limit. The inside diameter of the second stage tine includes an undercut portion and is machined with a reverse taper. The undercut portion allows space for any axial misalignment of the pins and the reverse taper provides for contact primarily at the tip section of the tine which, in turn, utilizes the entire length of the tine as a spring member and allows higher normal forces, as well as early establishment of electrical contact integrity during mating and unmating. The distance the tip of the tine moves in and out (radially) during mating is relatively large for any given size of the contact which helps ensure that the normal forces will remain relatively constant regardless of variations that occur in the pin and socket diameters during machining and also due to dimensional changes that are caused by wear and from axial misalignment between the pin and socket. The contact tines are designed so that contact with a mated pin occurs primarily at the tip of each tine. This provides a deliberate, and relatively high pressure, contact patch that, in turn, provide optimum lines of current flow and which also serves to wipe the contacting surfaces (i.e., the contact patches) during mating and unmating to remove oxides and therefore to help maintain a low contact resistance.

DETAILED DESCRIPTION OF THE INVENTION

Figure 1:
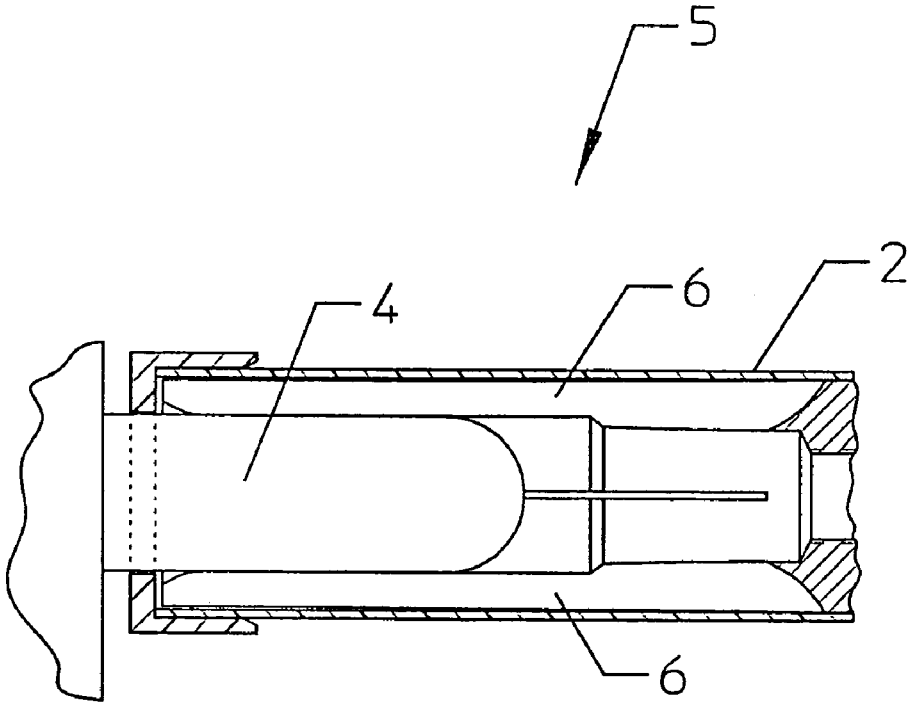
PRIOR ART Fig. 1
FIG. 1 is a cross-sectional view of a prior art type of a pin and socket connector.

Referring now in particular to FIG. 1 is shown a prior art type of a socket 2 and a pin 4 disposed therein, identified in general by the reference numeral 5. The pin 4 makes contact with each of the tines 6 along a substantial portion of the length of the pin 4.

This mechanical geometry requires that the center longitudinal axis of the pin 4 align precisely with the center longitudinal axis of the socket 2, else insertion of the pin 4 into the socket 2 become especially difficult.

In short, the prior art design is intolerant of axial misalignment between the pin 4 and the socket 2.

The prior art design is also based on the long-held belief in the electrical connector arts that for high current applications, a maximal area of contact is preferred. In accordance with prior contact design theory, it is believed that maximum contact area is required for high current loading and that a lesser area would result in a higher temperature rise.

Experimentation has shown, however, that the opposite is true, and that the prior art types of designs tend to experience a greater rise in temperature than the instant invention.

Figure 2:
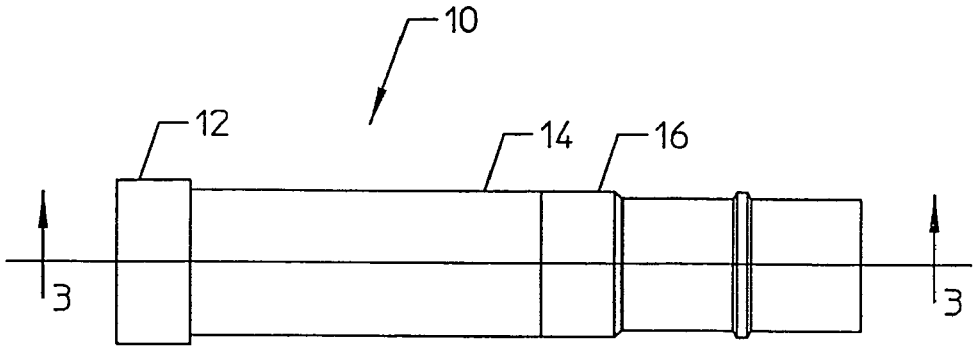
FIG. 2 is a side view of a socket that is used to form a low force electrical contact.
Figure 3:
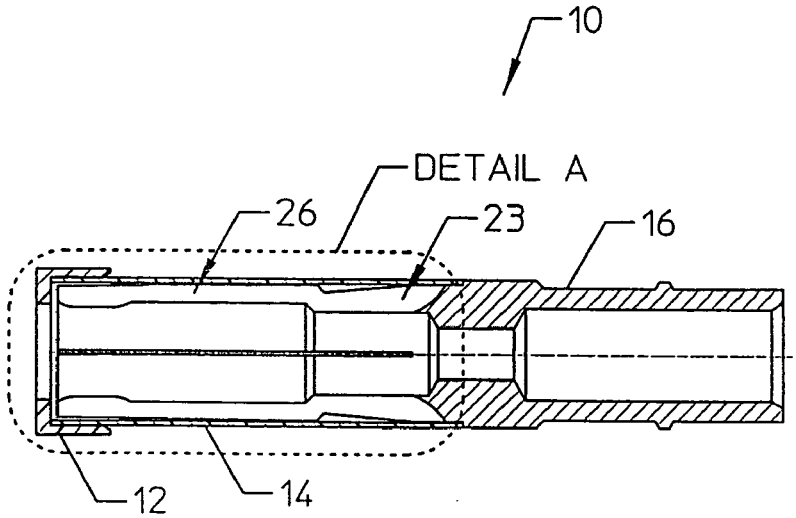
FIG. 3 is a cross-sectional view of the socket of FIG. 2 taken on the line 3—3 in FIG. 2.

Referring now to the remainder of the FIG. drawings, and in particular to FIG. 2 is shown a side view of a socket, identified in general by the reference numeral 10, as is used with the present low force electrical contact. FIG. 3 is a cross sectional view of the socket 10 of FIG. 2.

The socket 10 is of any preferred size and, although only one is shown, a plurality of sockets 10 are typically used in a socket half portion of a connector (not shown). The use of a plurality of sockets 10 to form a plurality of electrical connections is well known by those possessing ordinary skill in the electrical arts.

The socket 10 includes an insulator tip 12 that is disposed over a hood 14 at a first end thereof. A second opposite end of the hood 14 is disposed around a socket contact 16.

The socket contact 16 extends to the rear of the socket 10 and is adapted for attachment to a wire (not shown).

Methods of attaching the socket 10 to the wire are well known in the art. One preferred method of attachment includes crimping of the socket contact 16 around the wire and another common method includes soldering the wire to the socket contact 16. Any preferred method may be used.

Figure 4:
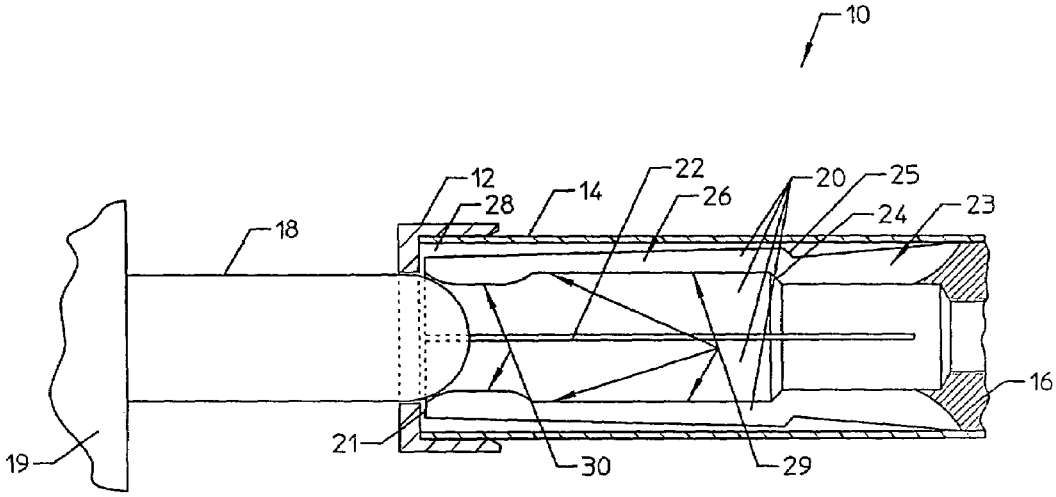
FIG. 4 is an enlarged cross-sectional view of a nose portion of the socket of FIG. 2, as shown within a dashed area, in an unmated condition, with a pin proximate thereto.

Referring now to FIG. 4 an enlarged cross-sectional view of the nose portion of the socket of FIG. 3 is shown. A pin 18 is disposed proximate the socket 10 and prior to the mating of the two together. A pin half of a connector 19 (i.e., that portion that houses the pin(s) 18 mates with the socket half of a connector (that portion that houses the socket(s) to complete the electrical connection).

A plurality of tines 20 are provided which are electrically and mechanically mated with the socket contact 16 or a portion thereof. Each of the tines 20 are separated by a slot 22 that is disposed intermediate each tine 20. Each slot 22 (four if four tines 20 are used) extends substantially the longitudinal length of the tines 20. Therefore, the socket 10 is generally of the type that is commonly referred to as a "split-tine".

The tines 20 are formed of a high yield strength type of conductive metal and therefore have an ability to spring back into position. Therefore, the tines 20 need not be set inward nor are external helper springs required to produce a normal force (i.e., a force applied to the tines 20 that urges the tines 20 toward the center of the socket 10 and which helps to ensure electrical conductivity when the pin 18 is mated with the socket 10), as is described in greater detail hereinafter.

Each of the tines 20 includes a first stage, identified in general by the reference numeral 23, that is disposed adjacent the socket contact 16 portion with which it is in electrical contact. The slot 22 intermediate each of the tines 20 terminates in the first stage 23, near the socket contact 16 portion. Accordingly, the tines 20 are each joined together in a common area of the first stage 23 proximate the socket contact 16.

An inner shoulder 24 tapers outward as does an outer shoulder 25 which, together, transition the tine 20 into a second stage, identified in general by the reference numeral 26. The second stage 26 extends from the inner shoulder 24 toward the insulator tip 12 and is thinner than the first stage 23. The second stage 26 terminates at a tip 21 of the tine 20.

Accordingly, the first and second stages 23, 26 of each tine 20 function as a two stage spring that tends to supply the necessary normal force to urge the tip 21 of the tine 20, generally, a limited amount toward the center of the socket 10. The high yield strength metal allows each stage 23, 26 of the tine 20 to function as a more capable and durable spring.

The tines 20 are machined so as to provide a natural offset of the tip 21 toward the center of socket 10 (i.e., away from the hood 14). This ensures that when initial contact of the pin 18 is made with the tine 20, that it is the tip 21 of the tine 20 that first makes contact with the pin 18. This is described in greater detail hereinafter.

The first stage 26 adds compliance (i.e., an ability to flex within the normal operating range of the first stage 26 as a spring). This is useful to protect the socket 10 from permanent deformation or loosening in response to side loads that are inflicted by the pin 18 upon the tines 20 when a rocking motion is used to insert the pin half of the connector 19 into the socket half of a connector.

The hood 14 limits the maximum radial extension that is possible for each tine 20, thereby ensuring that not even an excessive rocking motion by the pin(s) 18 can displace the tines 20 so far that any of them can become permanently deformed or loosened. Accordingly, the ability to apply a normal force by the tip 21 of the tine 20 upon the pin 18 for the useful life of the socket 10 is ensured.

In the unmated state, the outside diameter of the tines 20 is less than the inside diameter of the hood 14, which provides a gap 28 therebetween.

Figure 5:
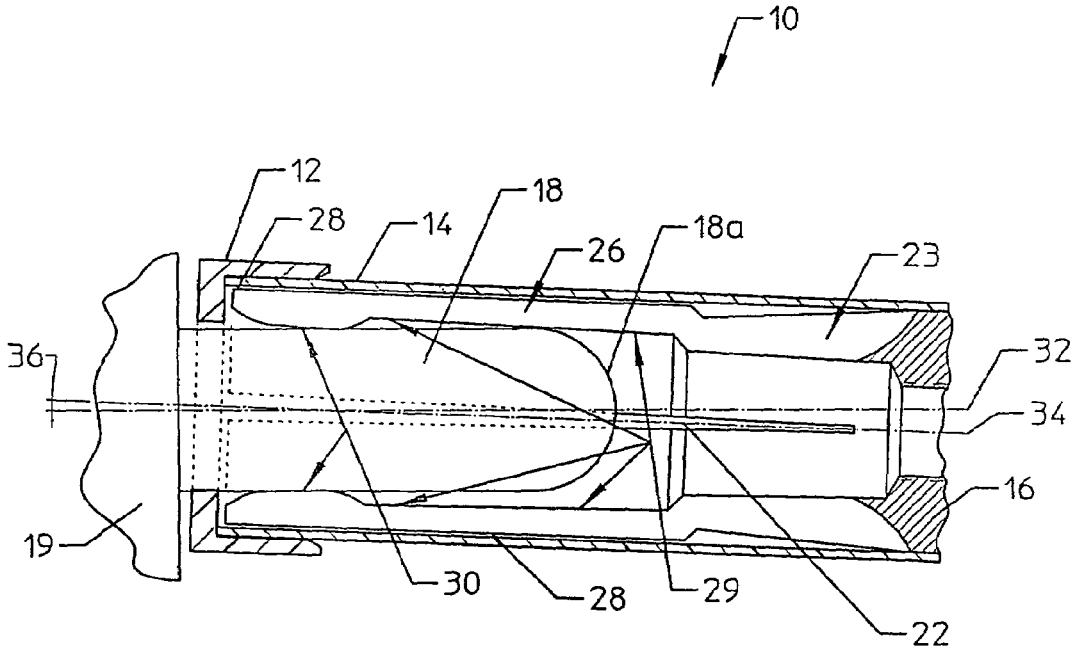
FIG. 5 is an enlarged cross-sectional view of a nose portion of the socket of FIG. 2, as shown within a dashed area, in a fully mated condition.

The outside diameter of the tines 20 is also tapered, so that when the socket 10 is fully mated with the pin 18, the outside profile of the tines 20 becomes nearly cylindrical along the entire longitudinal length thereof (See FIG. 5). This provides a minimal clearance (i.e. the gap 28) in the mated state between the outside of the tines 20 and inside diameter of the hood 14. This, in turn, constrains the tines 20 and prevents them from loosening. The hood 14 is preferably formed of a metallic material.

Referring now also to FIG. 5, the inside diameter of the second stage 26 of each tine 20 is machined with an area that is undercut 29 beginning a predetermined distance inward from the tip 21. The undercut 29 extends in a direction toward the socket contact 16 and terminates at the inner shoulder 24.

This makes each of the tines 20 thicker proximate the tip 21 and it creates a "patch" of contact, identified in general by arrow 30. The patch 30 of each tine 20 is that portion of the tine 20 that makes initial contact with the pin 18 during mating. The patch 30 is maintained during the entire mating/unmating cycle.

It is also apparent that because contact occurs primarily at the patch 30 proximate the tip 21 of each tine 20, the entire length of the tine is utilized as a two-stage spring member and allows for higher normal forces to be designed into the socket 10 while minimizing any chance that side loads will result in permanent yielding.

An additional benefit that is provided is that proper normal force, and therefore electrical contact integrity, is established early on in the mating stroke and is maintained even after partial unmating has occurred.

There is another significant benefit that is provided by this configuration. As stated hereinabove, the normal force is provided by each tine 20, which functions as a long two stage spring. The distance the tip 21 of the tine 20 moves radially upon mating is the amount of "spring travel" and this, for any given size of the socket 10, is relatively large.

Accordingly, the normal force that is provided is less dependent on variations of the outside diameter of the pin 18 and the inside diameter of the socket 10 that are caused by either machining tolerances or wear over time. Having less critical tolerances decreases manufacturing cost. A more constant normal force that is less affected by wear helps to provide a reliable long lasting electrical contact.

Because the normal force that is provided is less subject to variation, so too are the mate and unmate forces less dependent upon tolerances or wear. Similarly, the voltage drop that can be expected to occur intermediate the tine 20 and the pin 18 is less dependent upon tolerance or wear.

During insertion and removal of the pin 18 from the socket 10, each tine 20 wipes the pin 18 along the patch 30. This helps to remove oxidation from either the pin 18 or the patch 30, thereby ensuring low electrical resistance and optimum current flow. The patches 30 effectively utilize the normal force that is supplied by the spring action of the tines 20 to maximize the contact force.

If there are four tines 20 in the socket 10, then there would be four patches 30 in the socket 10, each patch 30 of which is adapted to provide positive electrical contact intermediate the tines 20 and the pin 18 and to do so at a higher pressure (for any given normal force than prior art designs) being applied to the pin 18 by the tines 20.

Furthermore, due to the geometry provided, it can now be controlled and therefore predicted where electrical contact will physically occur and therefore where current flow will occur. It will occur primarily along the patch 30 of each tine 20 and primarily toward the tip 21 of each tine 20.

If desired, the patch 30 can be modified to vary the areas of contact that occur with the pin 18. One of these methods is disclosed in greater detail in related co-pending patent application that was filed on Jul. 27, 2001, Ser. No. 09/916,749 by the same inventor and which has been incorporated by reference herein.

For example, if the patch 30 area of each of the tines 20 is modified and machined so as to include an inside radius that is less than the outside radius of the pin 18, contact with the pin 18 would occur intermediate each tine 20 and each pin 18 along two lines of contact that are in parallel longitudinal alignment with the pin 18 and which are disposed along two outer edges of the patch 30. See FIG. 7 of the above-identified related application.

Then, during insertion and removal of the pin 18 from the socket 10, each modified tine (not shown) would wipe the pin 18 along its two outer edges. Those edges would effectively utilize the normal force supplied by the spring action of the modified tines to maximize the contact forces that occur by concentrating them.

If there are four modified tines in the socket 10, then there would be eight edges of contact (with the pin 18) in the socket 10, each edge of which is adapted to provide positive electrical contact with the pin 18 and to do so at a higher pressure (in pounds per square inch) for any given normal force than would otherwise be possible.

Furthermore, the lines of electrical contact would be predicted to occur along the edges. The edges would also serve to mechanically wipe the contact surfaces, thereby removing oxidation that forms on either the pin 18 or on the edges of the patch 30 or both.

The electrical contact that is provided by the edges would also serve to create two parallel lines of current flow (for each modified tine) that are optimally configured to run longitudinally inward and up the modified tine, exactly as is physically desired.

This preceding discussion is intended to show that additional and further modifications can be made to the instant invention, as desired, without departing from the spirit and scope.

Referring once again to the drawing figures, the pin 18 of FIG. 5 includes a first longitudinal center axis 32 that does not align with a second longitudinal center axis 34 of the socket 10. For this to occur either one or both of two conditions must occur.

One such condition occurs when the pin half of the connector 19 is rocked side to side. The undercut 29 provides clearance for a nose portion 18*a* of the pin 18 to move sideways without contacting the interior of the tine 20. This tends to keep insertion and removal forces low, even if the pin half of the connector 19 is rocked during insertion or removal.

The other condition that results in misalignment of the first longitudinal axis 32 with respect to the second longitudinal axis 34 occurs when a plurality of pins and sockets are included in the connector and all of them do not share parallel axes. The reasons why this can occur were discussed in greater detail hereinabove in the BACKGROUND OF THE INVENTION section of the specification.

It does not matter if the misalignment is caused by certain of the pins 18 or certain of the sockets 10, or both. When a plurality of electrical contacts occur in a given connector and there are any pins 18 or sockets 10 that do not have parallel axes, a misalignment of the first and second longitudinal axes 32, 34 will occur.

The undercut 29 allows the pin 18 to mate with the patches 30 and provides clearance for the nose of the pin 18*a* as it enters into the socket 10 when axial misalignment occurs. The undercut 29 prevents excessive displacement of the tines 20 from occurring under such conditions which in turn prevents a substantial increase in insertion or removal force from occurring.

In a prior discussion, an example was provided where six contacts normally experience (by themselves) an insertion force of ten pounds per contact but where the total insertion force is ninety pounds (not sixty) due to misalignment of the axes 32, 34.

According to the instant invention, an angular misalignment 36 up to approximately three degrees can be accommodated without incurring a substantial increase in insertion (or withdrawal) force.

When the pin 18 is fully inserted into the socket 10, each slot 22 expands accordingly to accommodate the radial extension of each tine 20. When fully inserted, the pin 18 does not enter into the socket 10 beyond the first stage 26 of the tines 20.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A low force electrical contact, comprising:

(a) a socket;

(b) a plurality of tines disposed in said socket;

(c) said plurality of tines adapted to receive a pin, wherein said pin includes a first center longitudinal axis that is not in parallel alignment with a second center longitudinal axis of said socket, (d) means for connecting a wire to said socket;

wherein said plurality of tines are adapted to contact said pin during its insertion when an axial misalignment occurs in any direction between a center longitudinal axis of said pin and a center longitudinal axis of said plurality of tines;

and including an undercut portion in each of said tines a predetermined distance from said tip;

wherein each of said tines includes a patch of material that is adapted to contact a pin, said patch being disposed intermediate said tip and said undercut portion;

wherein a diametrically opposed pair of said patches of material includes an inside diameter that is less than an inside diameter of said undercut portion, and wherein said socket includes a hood having a predetermined inside diameter that surrounds said plurality of tines, and wherein when said pin is mated inside of said socket, said plurality of tines extend radially outward a greater amount at said tip than at a socket contact, and wherein a gap that exists intermediate said plurality of tines and said inside diameter of said hood is substantially identical along the longitudinal length of said plurality of tines.

2. The low force electrical contact of claim 1 wherein each of said tines includes a first stage and a second stage, said first stage having a first wall thickness that is thicker than a second wall thickness of said second stage that is disposed proximate to said first stage and which extends therefrom toward a tip of each tine.

3. The low force electrical contact of claim 1 wherein said undercut portion extends to said first stage.

4. The low force electrical contact of claim 1 wherein said patch of material includes a greater thickness of material than said undercut portion.

5. The low force electrical contact of claim 1 wherein each of said plurality of tines is adapted to extend radially away from a center longitudinal axis.

6. The low force electrical contact of claim 3 wherein each of said plurality of tines is adapted to make contact with said pin along a portion of the longitudinal length of each of said plurality of tines proximate a tip of each of said tines when said pin is inserted into said socket.

7. The low force electrical contact of claim 1 wherein each of said plurality of tines is machined wherein a tip of each of said plurality of tines is normally disposed closer to a center of said socket when said socket is not mated with a pin than is a second end of each of said plurality of tines that is disposed distally from said tip, said second end being disposed at an opposite end of each of said plurality of tines than said tip.

8. The low force electrical contact of claim 1 wherein each of said plurality of tines includes a first outside diameter that is proximate a tip and a second outside diameter that is greater than said first outside diameter, said second outside diameter being disposed distally from said tip, and wherein each of said plurality of tines progressively increases in the outside diameter from said tip to a distal end said distal end being disposed at an opposite end of each of said plurality of tines than said tip.

9. The low force electrical contact of claim 1 wherein said socket is adapted to accommodate an angular misalignment of a first center longitudinal axis of said pin with respect to a second center longitudinal axis of said socket.

10. The low force electrical contact of claim 9 wherein said angular misalignment is equal to or less than three degrees in magnitude.

* * * * *